US006811153B1

(12) United States Patent
Ko

(10) Patent No.: US 6,811,153 B1
(45) Date of Patent: Nov. 2, 2004

(54) METHOD OF PLAYING IMPROVED CARD GAMES

(76) Inventor: Shenli Ko, P.O. Box 82225, Las Vegas, NV (US) 89180

( * ) Notice: Subject to any disclaimer, the term of this patent is extended or adjusted under 35 U.S.C. 154(b) by 0 days.

(21) Appl. No.: 10/369,250

(22) Filed: Feb. 19, 2003

(51) Int. Cl.[7] ..... A63F 1/00
(52) U.S. Cl. ..... 273/292; 273/274
(58) Field of Search ..... 273/292, 274, 273/309; 463/12, 13

(56) References Cited

U.S. PATENT DOCUMENTS 5,584,486 A * 12/1996 Franklin ..... 273/292
5,685,774 A * 11/1997 Webb ..... 463/13
5,743,532 A * 4/1998 Lafferty ..... 273/292
5,931,472 A * 8/1999 Ko ..... 273/292
6,007,424 A * 12/1999 Evers et al. ..... 463/13
6,012,720 A * 1/2000 Webb ..... 273/292
2003/0094761 A1 * 5/2003 Furuta et al. ..... 273/292

* cited by examiner

*Primary Examiner*—Benjamin Layno
(74) *Attorney, Agent, or Firm*—Robert Ryan Morishita; Anderson & Morishita, LLC

(57) ABSTRACT

A player places a base wager and an optional proposition wager in a card game or the game of Pai Gow tiles or in Three-Card Poker where all players compete against the dealer on the base wager. If the dealer receives one of predetermined hand combinations, a player making the optional proposition wager is paid odds on the proposition wager. Additionally, if the dealer receives one of the predetermined dealer hand combinations and the player also receives one of predetermined player hand combinations, players are paid higher odds. Additionally or alternatively, in lieu of just a proposition payoff, the player may be paid an enhanced winning base game award or be waived a commission when the dealer or the player himself has a predetermined qualifying hand combination.

25 Claims, 2 Drawing Sheets

METHOD OF PLAYING IMPROVED CARD GAMES

FIELD OF THE INVENTION

The present invention relates to gambling games. More specifically, the present invention relates to methods for improved play of Chinese Pai Gow (tiles), Pai Gow Poker and Three Card Poker.

BACKGROUND OF THE INVENTION

Pai Gow tiles and Pai Gow Poker are two well known gambling games that may be banked by a casino or a player. The player has to arrange their tiles or cards into a high hand and a low hand. The low hand must not be of a higher ranking than the high hand. The dealer or banker also arranges his tiles or cards into a high hand which will be compared to the player's high hand, and a low hand which will be compared to the player's low hand. In the event of a "copy" where the low hands tie or the high hands tie (are of the same rank), the dealer wins the tie. The player must win both the high and low hands to win their bet. If one hand loses and the other hand wins, it is a push. The player is charged a five percent commission on their winning hand.

Pai Gow Poker is a game which is played with a single deck of cards with or without the use of a joker. A game of Pai Gow Poker begins with the players making a wager. A dealer shuffles the deck of cards. Three dice are rolled to determine the distribution of the hands. A hand of seven cards is dealt to each player and the dealer. Each player organizes his or her seven cards into a two-card low hand and a five-card high hand. The low hand must not have a higher ranking than the high hand according to the conventional ranking of poker. If the hands are incorrectly arranged, the player automatically loses. The player positions his cards on the playing surface with the two-card low hand in front of the five-card high hand.

The dealer reveals his cards and likewise organizes the seven cards into a five-card high hand and a two-card low hand. Wagers are resolved by comparing the rank of the player's high hand and low hand to the dealer's high hand and low hand, respectively. If the players high and low hands outrank the dealer's high and low hands, respectively, the player wins and is paid even money, less a five percent commission to the casino. If the dealer's high and low hands outrank or tie the player's high and low hands, respectively, the dealer collects the player's wager. If one, but not both, of the player's hands outrank the one of the dealer's hands, the game is a push and the wager is neither collected nor paid.

The game of Pai Gow tiles is played with a set of thirty-two Chinese Pai Gow tiles. It begins with the players making a wager. A dealer shuffles the set of tiles and arranges them into eight stacks of four tiles each. Three dice are rolled to determine the distribution of the hands. A hand of four tiles is dealt to each player and the dealer. Each player organizes his or her four tiles into a two-tile low hand and a two-tile high hand. The low hand must not have a higher ranking than the high hand according to the conventional ranking of Pai Gow. If the hands are incorrectly arranged, the player automatically loses. The player positions his tiles on the playing surface with the two-tile low hand in front of the two-tile high hand.

The dealer reveals his tiles and likewise organizes the four tiles into a two-tile high hand and a two-tile low hand. Wagers are resolved by comparing the rank of the player's high hand and low hand to the dealer's high hand and low hand, respectively. If the player's high and low hands outrank the dealer's high and low hands, respectively, the player wins and is paid even money, less a five percent commission to the casino. If the dealer's high and low hands outrank or tie the player's high and low hands, respectively, the dealer collects the player's wager. If one, but not both, of the player's hands outrank the one of the dealer's hands, the game is a push.

Three Card Poker, as disclosed in Webb, U.S. Pat. No. 5,685,774, the disclosure of which is hereby incorporated by reference, is a three-card poker game played with a single deck of cards. The player makes an ante bet before the hand is dealt. The player and dealer each will get three cards face down. After looking at the cards, the player has the option to fold and forfeit the ante bet or to stay in the game by putting up a Play bet equal to the ante. After all players have made their decision, the dealer turns his hand over and checks to see if his hand is Queen-high or better. If not, the dealer does not qualify to play against all player hands so all players are paid even money on the ante and the Play bet is a push. If the dealer does qualify, then the dealer hand is compared with the player hand and whoever has the higher 3-card poker ranking wins the hand. If the player hand is a straight or better, the ante bet is paid odds automatically regardless of the dealer hand. In the event of a tie, the ante and the Play bet push. In addition to the ante bet, the player also can make an optional Pair Plus bet which is played against a predetermined pay table. If the player's own hand is one pair or better, the Pair Plus bet is paid odds according to the predetermined pay table.

My U.S. Pat. No. 5,931,472, the disclosure of which is hereby incorporated by reference, describes an improved game of Pai Gow tiles in which a player can make an optional bonus wager. If the player is dealt one of several predetermined hands such as Wong, Gong and pairs, the player is paid odds according to a pay table.

Franklin, U.S. Pat. No. 5,584,486 describes an improved game of Pai Gow Poker in which a player is permitted to make a jackpot wager along with the mandatory Pai Gow Poker wager, with the player winning the jackpot wager when he is dealt a predetermined seven card jackpot holding such as a pair low hand and straight or better high hand. The odds increase in view of the rarity of the seven card hands, up to, for example, 50,000:1 for five aces and a pair.

Another known modification of the Pai Gow Poker game is called Fortune Pai Gow Poker, where the player has the option to make a bonus bet. This bonus bet is won at predetermined odds if the player has any five cards which can form a straight or better (with the odds increasing for increasingly ranked hands). In addition, if a player makes a bonus bet of at least $5, that player can additionally win a predetermined "envy bonus" if any other player has any five cards which form a poker rank of four of a kind or higher.

Evers, et al U.S. Pat. No. 6,007,424 describes a modified game of Pai Gow Poker which reduces the number of pushes and pays odds if the player hand has a predetermined poker ranking. For a winning outcome, the player's high and low hands must outrank the corresponding dealer high and low hands. A push is declared if the player's high hand (i) outranks the corresponding dealer's high hand and (ii) has at least a pair of Jacks, and the dealer's low hand outranks the player's low hand. All other outcomes are declared losing outcomes for the player. As a further feature, should the outcome be (i) a player win and (ii) the player's high hand be of a predetermined qualifying holding, the player is paid a higher amount according to a predetermined payout schedule.

While such games are entertaining and useful in the gaming industry to increase interest and betting, games with still more betting options are desirable. For example, all traditional casino games allow the player to bet that they will be dealt a premium hand and be paid higher odds the better their hand is. None of the games offer a bet on the dealer hand being a bad hand. While players love to be dealt a good hand, they also love to see the dealer get a poor hand so they can beat the dealer easily. Therefore, a game can be more fun if the player can bet that the dealer will be dealt a bad hand and get paid for that. The worse the dealer hand is, the more the player is paid. In such cases the player will typically win their wager as well as a dealer "bad hand" wager. Thus the player will perceive the outcome as a double win for the player. Furthermore, since the award is based upon the dealer's hand, all player(s) are wagering on the same event and therefore win together. This promotes a comradery among the players.

Furthermore, typical poker games include other features that discourage play or decrease players' incentive to play. These games prohibit players from winning all of the bets if the dealer's hand is disqualified. For example, Three Card Poker, Three Card Stud and Caribbean Stud Poker require that the dealer's hand be qualified with a Queen, Queen-Eight or Ace-King, respectively. Failure of the dealer to qualify with such hands results in all of the players having no opportunity to win their back/additional bet and a big bonus payoff (e.g., the bonus payoff in Caribbean Stud Poker) with the cards the players were dealt. Thus, a player making a large bet based on a good hand could have the possibility of winning removed solely on the basis of the dealer's hand, and completely outside the player's expectation of winning given the hand the player has been dealt.

There is a need for offering a bonus for the games of Pai Gow Poker and Pai Gow tiles which provides the player with an additional opportunity to receive an award and pay the commission less often.

There is also a need for the games of Pai Gow Poker, Pai Gow tiles and Three Card Poker which provide for an additional wager by the player to participate in the bonus feature. In this regard such a feature would provide the casino with an additional revenue source.

There is also a need for the games of Pai Gow Poker and Pai Gow tiles which offer a bonus of greater than even money to entice the players to participate in the bonus feature.

Alternatively, there is a need for a method and device which provide for an additional award feature without the necessity of the player making the bonus wager.

SUMMARY OF THE INVENTION

There is therefore set forth according to the present invention a method for playing an improved game of one of Pai Gow tiles, Pai Gow Poker and Three Card Poker, which may be embodied in either a table game format or in an electronic device.

In one embodiment, the method for playing the improved game of Pai Gow Poker includes the player prior to the dealing of the cards opting to make a proposition (side) wager in addition to making a base wager. After the wagering option has been exercised, the dealer deals seven cards to each player and himself in the traditional Pai Gow Poker fashion. Each player and the dealer arrange their cards into the two-card low hand and the five-card high hand, the high hand having a higher ranking than the low hand according to the rules of ranking of Pai Gow Poker hands, also in the traditional fashion. If the player has made the base wager and both his high and low hands outrank the dealer's corresponding high and low hands, the player is declared to have obtained a winning outcome and the player is rewarded based upon his base wager. As in traditional Pai Gow Poker the reward on the base wager is usually a payoff of even money with the casino collecting a five percent commission on winning hands. If one, but not both, of the player's high and low hands outranks a corresponding one of the dealer's high and low hands, the outcome is declared a push and the player neither loses nor wins their wager. All other outcomes are deemed a loss and the player loses their base wager.

According to one embodiment of the invention an improved game of Pai Gow Poker is set forth where, if one of or the holding of both of the dealer's low and high hands matches one of predetermined Poker hand combinations, players making the proposition wager are declared to have obtained a winning outcome and are rewarded based upon the amount of their proposition wager. The winning hand combinations may be any predetermined combinations of a preselected one or both of the dealer's hands; but preferably are combinations of poor, low ranking, hands that are easily beatable. The payoffs for winning proposition wagers may range from even money to, for example, 200:1. Moreover, to make the reward more enticing, if the dealer's hand(s) matches one of predetermined Poker hand combinations and a preselected one or both of the holdings of the player's low and high hands matches a predetermined Poker hand combination, players making the proposition wager are paid much higher odds such as 1000:1.

According to another embodiment of the improved game of Pai Gow Poker, a player having made a Pai Gow Poker base wager is paid at more than even money on his base wager if the dealer receives a predetermined hand combination and the player beats the dealer. For example, if the dealer hand is Jack-high or lower, the player is paid 3:2 if the player beats the dealer.

According to yet another embodiment of the improved game of Pai Gow Poker, a player having made a Pai Gow Poker base wager need not pay the commission if the dealer receives a predetermined hand combination and the player's hand outrank and beat the dealers. For example, if the dealer hand is King-high or lower, the player need not pay the commission if the player beats the dealer.

According to yet another embodiment of the improved game of Pai Gow Poker, a player having made a Pai Gow Poker base wager need not pay the commission if the player receives one of predetermined hand combination and the player's hands beat the dealer. For example, if the player high hand is flush or better, the player need not pay the commission if the player beats the dealer.

The invention as embodied in an improved game of Pai Gow tiles includes the player prior to the dealing of the tiles opting to make a proposition wager in addition to making a base wager. After the wagering option has been exercised, the dealer deals four tiles to each player and himself in the traditional Pai Gow fashion. Each player and the dealer arrange their tiles into the two-tile low hand and the two-tile high hand, the high hand having a higher ranking than the low hand according to the rules of ranking of Pai Gow tiles, also in the traditional fashion. If the player has made the base wager and both his high and low hands outrank the dealer's corresponding high and low hands, the player is declared to have obtained a winning outcome and the player is rewarded based upon his base wager. As in traditional Pai Gow tiles the reward on the base wager is usually a payoff of even money with the casino collecting a five percent commission on winning hands. If one, but not both, of the player's high and low hands outranks a corresponding one of the dealer's high and low hands, the outcome is declared a push and the player neither loses nor wins their wager. All other outcomes are deemed a loss and the player loses their base wager.

According to one embodiment of the improved game of Pai Gow tiles, if a preselected one or both of the low and high hand(s) match one of predetermined hand combinations, players making the proposition wager are declared to have obtained a winning outcome and are rewarded based upon the amount of their proposition wager. The winning hand combinations may be any predetermined combinations of the dealer's tiles but preferably are combinations of poor, low ranking hands that are easily beatable. The payoffs for winning proposition wagers may range from even money to, for example, 25:1. Moreover, to make the reward more enticing, if the preselected dealer hand(s) matches a predetermined bonus hand combinations and a preselected one or both of the player hand(s) matches a predetermined bonus hand combination, players making the proposition wager are paid much higher odds such as 500:1.

According to yet another embodiment of the improved game of Pai Gow tiles, a player having made a Pai Gow tiles base wager is paid more than even money if the dealer receives one of predetermined hand combinations and the player beats the dealer. For example, if the dealer high hand is selected and it is a two or lower, the player is paid 3 to 2 if the player beats the dealer.

According to yet another embodiment of the improved game of Pai Gow tiles, a player having made a Pai Gow tiles base wager need not pay the commission if the dealer receives one of predetermined hand combinations and the player beats the dealer. For example, if the dealer high hand is four or lower, the player need not pay the commission if the player beats the dealer.

According to yet another embodiment of the improved game of Pai Gow tiles, a player having made a Pai Gow tiles base wager is paid more than even money if the player receives one of predetermined hand combinations and the player beats the dealer. For example, if the player low hand is Wong or better, the player is paid 3 to 2 if the player beats the dealer.

According to yet another embodiment of the improved game of Pai Gow tiles, a player having made a Pai Gow tiles base wager need not pay the commission if the player receives one of predetermined hand combinations and the player beats the dealer. For example, if the player low hand is high 9 or better, the player need not pay the commission if the player beats the dealer.

The embodiment of the present invention incorporated into the method for playing Three Card Poker includes the player prior to the dealing of the cards opting to make a proposition wager in addition to making the ante wager and the optional Pair Plus wager. After the wagering options have been exercised, the dealer deals three cards, face down, to each player and himself. After looking at his cards, each player decides whether to fold and forfeit the ante or stay in the game by making a Play wager equal to the ante. If the player has made the ante and Play wager, his wagers will be resolved according to the aforementioned rules of Three Card Poker. If the dealer hand matches one of predetermined bonus hand combinations, players making the proposition wager are declared to have obtained a winning outcome and are rewarded based upon the amount of their proposition wager. The winning hand combinations may be any predetermined combinations of the dealer's three cards but preferably are combinations of poor, low ranking, hands that are easily beatable. The method may require the player hand defeat the dealer hand or, if the dealer has a bonus hand, the player may be rewarded regardless of whether or not his hand defeats the dealer's. The payoffs for winning proposition wagers may range from even money to, say, 30:1. Moreover, to make the reward more enticing, if the dealer hand matches one of predetermined hand combinations and the player hand matches a predetermined hand combination, players making the proposition wager are paid much higher odds such as 500:1.

As can be appreciated, the games provide for players to obtain high rewards during the play of the improved games of Pai Gow Poker, Pai Gow tiles and Three Card Poker. Rather than simply win even money (less a commission) for the base wager, players can participate in the proposition wager and reap greater rewards. Furthermore, if the dealer receives one of the predetermined hand combinations, a player having made a proposition wager is rewarded regardless of whether or not his base wager is won or lost. Furthermore, the player need not pay the commission if they or the dealer receive the predetermined hand combination, which will speed up the game and enhance the appeal of the game. Players certainly will play the game at the casinos where the commission is charged less often.

BRIEF DESCRIPTION OF THE DRAWINGS

These and other features and advantages of the present invention will become appreciated as the same becomes better understood with reference to the description, claims and drawing wherein:

DESCRIPTION

With reference to the drawings, the Pai Gow Poker game according to the present invention will now be described.

Pai Gow Poker

Figure 1:
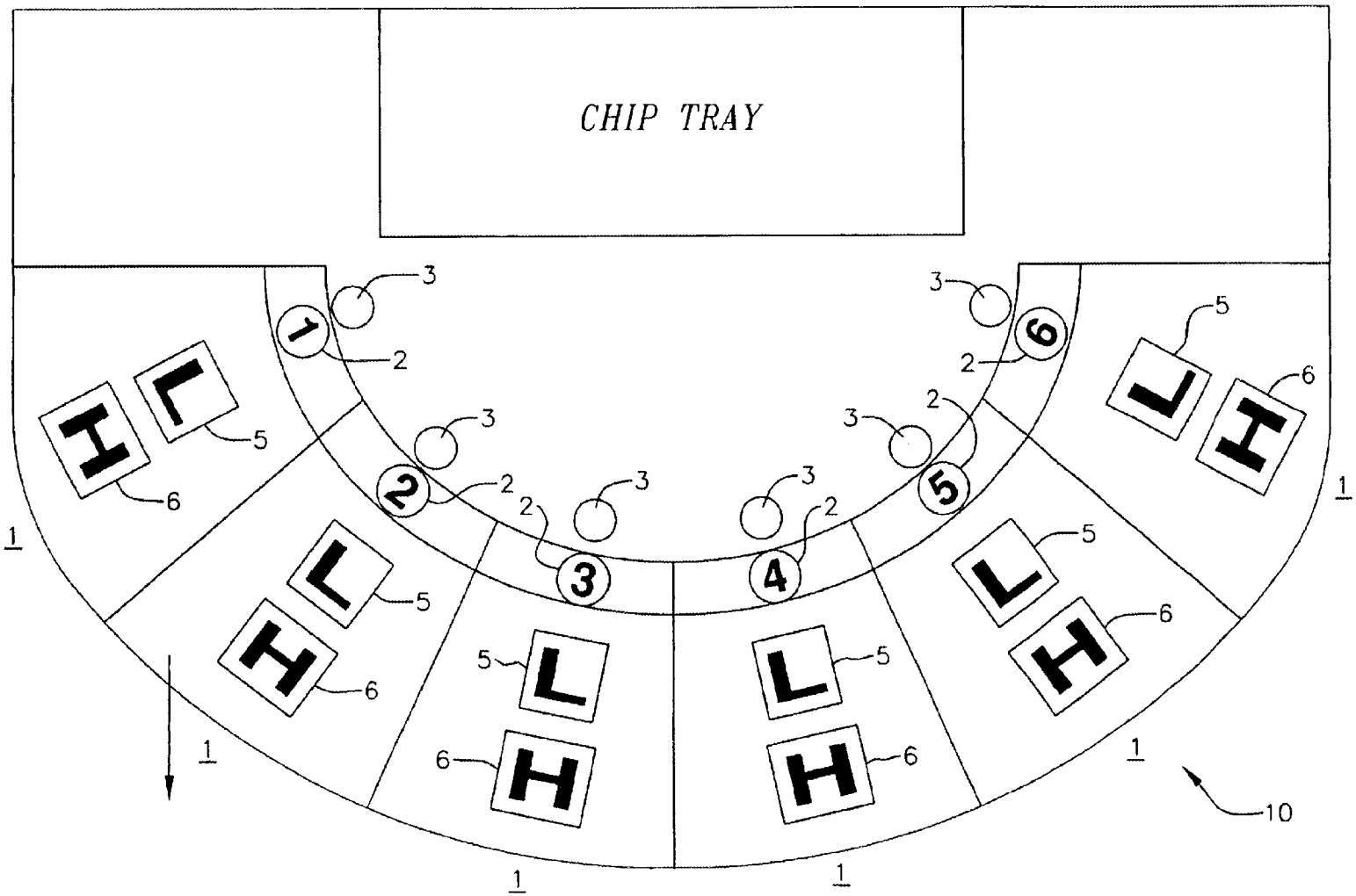
FIG. 1 shows a layout for the play of an improved game of Pai Gow.

Turning to FIG. 1, a layout 10 for play of the game is illustrated. The layout includes a playing surface of generally known construction defining six player positions 1 and a dealer position 4. Players sitting at the player positions 1 have presented in front of them on the layout 10, an action area where players receive and arrange their cards according to the play of Pai Gow Poker in a known fashion. Players place their two-card low hand in the card box 5 and their five-card high hand in the card box 6. Adjacent each action area is a base wager area 2 where the player places a base wager and a proposition wager (also referred to herein as a "side" wager) area 3 where the player places their proposition wager. In front of the dealer position 4 is a chip tray which holds chips during the play of the game.

With the layout 10 now described, the play of the game of Pai Gow Poker according to the present invention will now be described. While the following description is directed to play of the game as a live action game, it is to be understood that the method according to the present invention could be incorporated into an electronic device for play thereat by a player as hereinafter described. To play the game, each player makes a base wager and has the option to make a proposition wager. The player places their base wager in the base wager area 2 and any proposition wager in the proposition wager area 3 to signify to the dealer that the wagers are being made. Table minimums and maximums may dictate the minimum and maximum amount of such wagers that can be made by the player. Furthermore, should a player so desire, the player can declare himself the Banker for the hand in a manner well known with the play of traditional Pai Gow style games. If the player so declares himself to be the Banker, he then plays against the other players and the dealer and in essence books the base wagers. The proposition wagers are typically, where the gaming jurisdictions permit, banked by the casino. However, where house banking is not permitted, such as in some card clubs in California, the player acting as the dealer may bank the proposition wagers as well. However, typically the dealer, supplied by a casino, acts by default as the banker for the hands. The following description will assume that no player has declared himself the banker for the hand and therefore the casino dealer acts as the banker. The game can be dealt from a single deck of cards with or without jokers. In advance of dealing the hand, the dealer shuffles the cards either by hand or with the use of a shuffling machine. When a joker is used, (1) it can be used as an Ace or to complete a straight, flush or straight flush, or (2) it can be completely wild. After the players have made their wagers, the dealer shakes dice to determine who will get the first stack of cards. This is the same as is in traditional Pai Gow Poker. Thereafter the hands of seven cards are distributed to the players and the dealer as determined by the outcome of the dice. If less than six players are playing the game, undistributed hands are removed from play. The player having received their seven cards arranges their cards into a five-card high hand and a two-card low hand, the high hand having a higher ranking than the low hand according to the rules of ranking of Pai Gow Poker. Once the players have arranged the cards into the hands, they place their hands in front of them face down in the designated areas 5 and 6 respectively. Thereafter, the dealer turns over his cards and arranges them into a five-card high hand and a two-card low hand according to the same rules discussed above and lays the same out in front of the dealer's position 4. The players' hands are then resolved in order against the dealer's hands to determine if the player has obtained a winning, losing or tie outcome.

For players having made the base wager and where both their high and low hands outrank the dealer's high and low hands, the player is declared to obtain a winning outcome and the player is rewarded at even money for their base wager less a commission for the casino as in traditional Pai Gow Poker. According to an optional embodiment of the present invention, the player can be rewarded at an increased rate for their base wager if a preselected one or both of the dealer hand(s), e.g. the dealer's low hand, the dealer's high hand or the holding of all seven of the dealer's cards comprising both the dealer's low and high hands is a predetermined bonus holding. For example, the player is paid at 3 to 2 odds if the dealer hands (all seven of the dealer's cards) is Jack-high or lower. Because Pai Gow Poker is a relatively even game, the casino shall collect a commission, typically five percent (5%) from winning hands, to pay for hosting of the game.

If one, but not both, of the player's low and high hands outrank the dealer's, the outcome is declared to be a push and the player neither wins nor loses their wager. If the Banker/dealer's low and high hands outrank the player's low and high hands, that is deemed to be a losing outcome for the player and the base wager is lost. Furthermore, if the player has misarranged their hands such that the low hand outranks the high hand, that too is determined to be a losing outcome. For those players having made the bonus proposition wager, the make-up of a preselected one of both of the dealer's hands, e.g., the low hand, high hand or all seven dealer cards is compared to one or several predetermined dealer hand winning bonus card combinations to determine whether one of the predetermined winning bonus card combinations can be formed. While any suitable combination or arrangement can be selected as a winning combination, the following combinations for all seven of the dealer's cards are deemed to be dealer hand bonus combinations: 9-high, 10-high, Jack-high, Queen-high, King-high, Ace-high and a low pair.

The dealer's hand is examined to determine if a winning bonus combination for the player who has made the proposition wager can be found regardless of whether or not the player has obtained a winning outcome for the base wager. If the dealer has a predetermined bonus combination, the player is paid with a payoff based upon the amount of their proposition wager. An example of the payout schedule is as shown in Table 1 below:

TABLE 1

| Dealer Hand | Pay |
|---|---|
| 9-high (2345789) | 200 to 1 |
| 9-high (2346789) | 75 to 1 |
| 10-high | 20 to 1 |
| Jack-high | 9 to 1 |
| Queen-high | 6 to 1 |
| King-high | 3 to 1 |
| Ace-high | 2 to 1 |
| Pair of 4s or Lower | 1 to 1 |

In another embodiment, the player hand is considered in adjudicating the outcome in order to increase the payoff odds. For example, the player can be paid 1000:1 if the dealer has a 9-high and the player has a straight flush or better in his seven-card hand. Table 2 below is an example of the embodiment:

TABLE 2

| Dealer Hand | Pay |
|---|---|
| Any dealer 9-high with the player having a straight flush or better | 1000 to 1 |
| 9-high | 100 to 1 |
| 10-high | 20 to 1 |
| Jack-high | 8 to 1 |
| Queen-high | 6 to 1 |
| King-high | 3 to 1 |
| Ace-high | 2 to 1 |
| Pair of 4s or Lower | 1 to 1 |

Alternatively, the player hand can be a poor hand such as a 10-high in order to win the top payout. So, if the dealer has a 9-high and the player has a 10-high or lower the player can be paid 1000 to 1.

As stated above, even if a player has obtained a losing outcome for their base wager, the dealer may have a bonus combination entitling the player to a payoff for their proposition (side) wager. A player desiring not to play the proposition wager can simply play the base wager game and still be paid at more than even money if the dealer receives a qualifying hand combination, which is impossible in traditional Pai Gow Poker.

Further, as set forth above one of the hands, e.g., low hand or high hand, may be selected as the hand for the bonus holding. Alternatively, as set forth above, the entire dealer (and player) seven-card holding may comprise the bonus holding.

Pai Gow (Chinese Tiles)

The play of Pai Gow tiles is well known in the art and is described in my U.S. Pat. No. 5,931,472. According to one embodiment of the improved game of Pai Gow tiles of the present invention, at least one or the holding of both of dealer hands is designated as a bonus holding. To play the game, the player makes their base wager and a proposition wager according to the present invention. The dealer deals four tiles to each player and to himself. With reference to FIG. 1, the player's wagers and tiles may be placed in the appropriate areas. The player arranges his tiles into a two tile low hand and a two tile high hand. The ranking of the low hand must not be higher than the ranking of the high hand according to the rankings of Pai Gow tile hands. After the players have set their hands, the dealer likewise arranges his four tiles into a low hand and a high hand.

To resolve the base wager, the player's low and high hands are compared with the corresponding dealer low and high hands. The player wins if both his hands outrank the corresponding dealer's hands. The player is paid even money on his base wager, less typically a five percent commission. The player loses the base wager if both the dealer's hands outrank the player's. Tie rankings of hands are resolved in favor of the dealer. If one of the player's hands outranks the corresponding dealer hand but the other does not, that result is considered a push and the player neither wins nor loses their base wager.

If a preselected one or the holding of both of the dealer hand(s) matches one of predetermined bonus hand combinations, players making the proposition wager are rewarded based upon the amount of their proposition wager. The winning hand combinations can be, for example, any predetermined combinations of the dealer's four tiles but preferably are combinations of poor, low ranking, hands that are easily beatable. The payoffs for winning proposition wagers may range from even money to, for example, 25:1. An example of the embodiment is give in Table 3, where (i) the dealer high hand is used for determining the bonus holding and (ii) a dealer high hand of 2 to 6 or less is used as a winning bonus combination for the player.

TABLE 3

| Dealer High hand | Pay |
|---|---|
| 2-high | 25 to 1 |
| 3-high | 8 to 1 |
| 4-high | 3 to 1 |
| 5-high | 2 to 1 |
| 6-high | 1 to 1 |

Moreover, to make the reward more enticing, if the dealer high hand matches one of predetermined hand combinations and the player hand matches a predetermined hand combination, players making the proposition wager are paid much higher odds such as 500:1. An example of the embodiment is given in Table 4.

TABLE 4

| Dealer High Hand | Pay |
|---|---|
| Dealer 2-high and player Low hand is a pair or better | 500 to 1 |
| 2-high | 20 to 1 |
| 3-high | 7 to 1 |
| 4-high | 3 to 1 |

TABLE 4-continued

| Dealer High Hand | Pay |
|---|---|
| 5-high | 2 to 1 |
| 6-high | 1 to 1 |

According to one embodiment of the improved game of Three Card Poker, players having made a proposition wager is paid odds if the dealer receives one of predetermined hand combinations. Preferably, the hand combinations are poor, low ranking hands that are easily beat. For example, if the dealer hand is 10-high or lower the player is paid as follows:

TABLE 5

| Dealer hand | Pay |
|---|---|
| 5-high | 30 to 1 |
| 6-high | 12 to 1 |
| 7-high | 4 to 1 |
| 8-high | 3 to 1 |
| 9-high | 2 to 1 |
| 10-high | 1 to 1 |

In another embodiment of the improved game of Three Card Poker, the player hand is considered in adjudicating the outcome in order to increase the payoff odds. For example, the player can be paid 500:1 if the dealer has a 5-high and the player has a straight flush or better in his hand. Table 6 below is an example of the embodiment:

TABLE 6

| Dealer hand | Pay |
|---|---|
| Dealer 5-high and player Straight flush or better | 500 to 1 |
| 5-high | 30 to 1 |
| 6-high | 12 to 1 |
| 7-high | 4 to 1 |
| 8-high | 3 to 1 |
| 9-high | 2 to 1 |
| 10-high | 1 to 1 |

Alternatively, the player hand can be a poor hand such as 5-high to win the top payout. So, if the dealer has a 5-high and the player has a 5-high or lower the player can be paid 500 to 1.

According to another embodiment of the present invention, the player need not place a separate proposition wager. In this embodiment, if a preselected one or the holding of both of the dealer's hands matches a preselected bonus holding and the player wins their base wager, the commission is waived.

In yet a further embodiment of the present invention, where a preselected one or both of the dealer's hands is a preselected bonus holding or a preselected one or both of the player's hands is a preselected player bonus holding, the player may be rewarded at enhanced odds of, for example, 3:2.

Three-Card Poker

Figure 2:
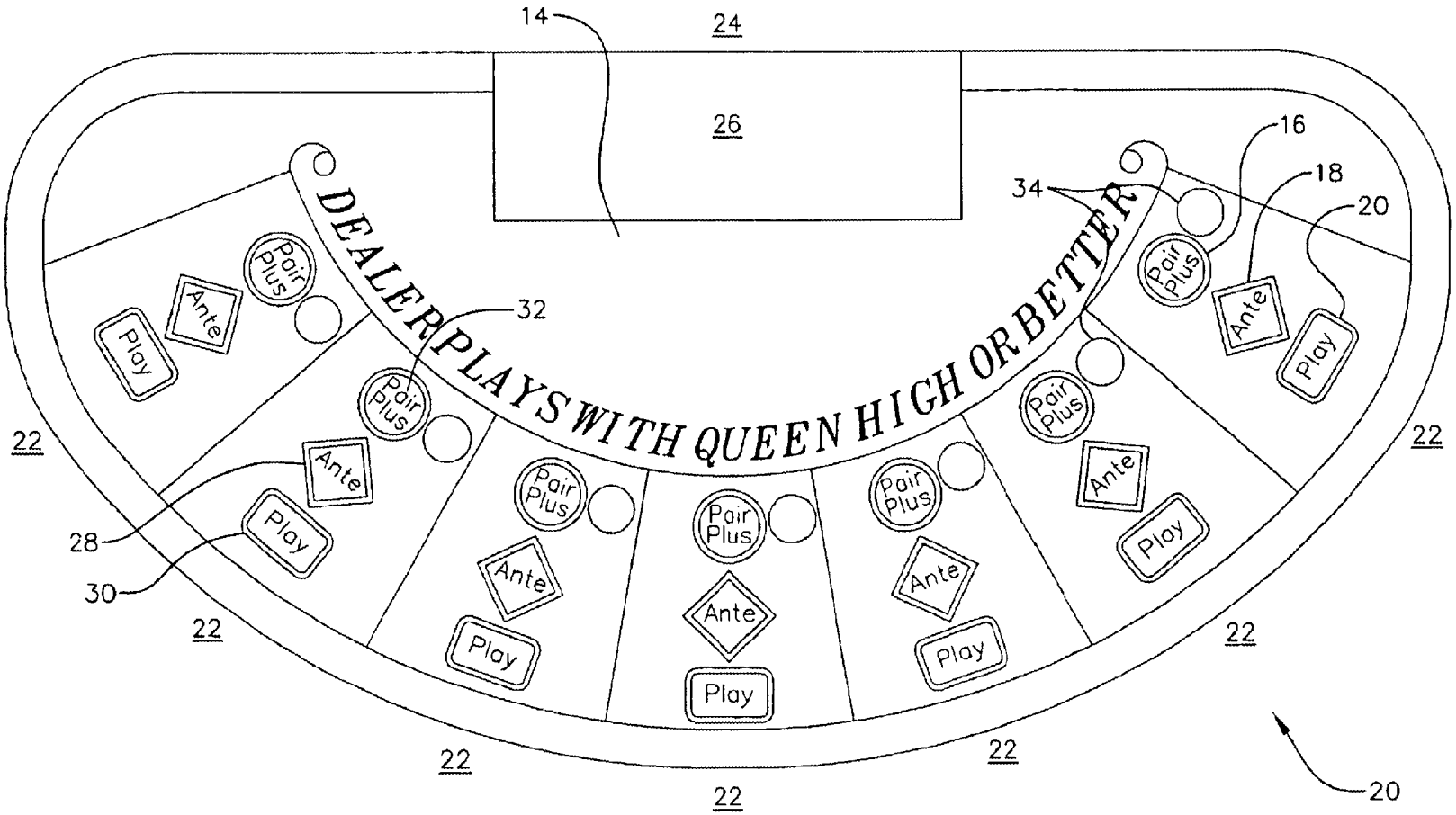
FIG. 2 shows a layout for the play of an improved game of three-card Poker.

FIG. 2 shows an example of a layout for the play of an improved game of three-card Poker. The layout 20 includes seven player positions 22 each accommodating a player. Opposite each player position 22 is the dealer position 24 for the dealer. A chip tray 26 is disposed at the dealer position 24.

At each player position 22 there are designated areas for the control of the game. The is an ante area 28 where the player places their ante bet and a play area 30 where the player places their play bet. Nearest the dealer position 24 is a pairs plus bet area 32 where the player places their pairs plus wager.

To play the game the player makes a base game wager by placing an ante bet in the ante bet area 28. The player may also make the optional pairs plus wager by placing their wager in the defined area 32.

After each player has made their wager(s) the dealer deals three cards to the player and to himself. The player examines their three cards and opts to (i) stay in the hand by placing a play wager in the play area 30 or (ii) fold thereby forfeiting their ante wager which is collected by the dealer. The pairs plus wager remains since the player, for that wager is playing against, a predetermined pay table. However, from a practical standpoint, if the player folds they do not have a qualifying pairs plus holding.

If the player stays in the hand, the dealer reveals his hand. The dealer must have a qualifying holding (Queen high) or better. If not, each player wins their ante wager, the play wager is a push and, if the player has a qualifying holding, they win their pairs plus wager. If the dealer does qualify, and his hand outranks the player's, the player loses their ante and play wager. If the hands tie, the ante and play wagers are a push. If the player's hand outranks the dealer's, the player wins their play and ante wager as well as their pairs plus wager if they have a predetermined holding. Regardless of the outcome and the dealer qualifying, the ante is paid odds if the player has a straight or better.

According to the present invention, each player position 22 has a proposition wager area 34 for the player to place a wager. Further, at least one and preferably a plurality of dealer hand combinations are designated as bonus holdings. Preferably, these holdings are poor (low ranking) dealer hands, which may be non-qualifying dealer hands. If the dealer's hand matches a bonus combination, the player wins an award based upon their proposition wager. Thus, even though the dealer may not qualify, the player may win their proposition wager.

As a further embodiment, certain player hand combinations may be designated as a player bonus hand. In the event that (i) the dealer has a bonus combination and (ii) the player has a bonus combination, the player may receive an enhanced award based upon their proposition wager.

The games thus described provide the players with an opportunity to reap great rewards of up to 1000:1 or the like. This contributes to the excitement of the play. Furthermore, a player can receive a payout even though they may lose a base wager to the dealer. As a further advantage, by selecting the winning combinations as described above, there will be frequent payoffs. It is estimated that a Pai Gow Poker player will win one of every four proposition wagers. Still further, no skill is required to play the proposition wager. This increases the excitement for the players. Furthermore, the game will be more fun because the player can bet that the dealer will be dealt a bad hand and get paid. Still further, regardless of whether or not a player acts as the Banker for the hand, the house or casino may always bank the proposition wagers so they won't lose any revenue as a result of player banking.

It should be understood that the live play game method described above may be played by multiple players and a live dealer using a digital gaming table, i.e., a live table having a computer display for each player and where a computer selects and displays hands from a computer generated or "virtual" deck. This embodiment may automatically set the player's and dealer's hands and if desired, within the rules of setting hands according to Pai Gow tiles or Pai Gow Poker, may override the computer's setting. Thus, the decisions for the player would be how much to wager, whether to make the proposition wager and whether to override the computer's setting of the player's hand.

Further, the game method may be programmed for Internet play or into a compact disk for virtual play against other remote players or against fictitious, virtual players for enjoyment.

While I have shown and described certain embodiments of the present invention it is to be understood that it is subject to modifications without departing from the spirit and scope of the claims.

What is claimed is:

1. An improved method for the play of a wagering game, the improvement comprising:

providing a set of game indicia for play of the game;

establishing a predetermined ranking of hands of said game indicia;

the player making a base wager;

after the player makes said base wager, distributing a player hand of game indicia and a dealer hand of game indicia;

the dealer arranging the dealer hand of game indicia into at least one game hand;

the player arranging the player hand of game indicia into at least one game hand;

comparing the ranking of each game hand of the player hand to the ranking of a corresponding game hand of the dealer hand;

resolving said base wager;

designating at least one dealer hand indicia combination as a bonus outcome; and if the dealer hand matches said bonus outcome providing an award to the player based on said base wager placed prior to the distribution of any game indicia.

2. The improved method of claim 1 wherein the wagering game is of the type where, if each game hand of the player hand outranks each game hand of the dealer hand, the player is rewarded even money on said base wager, the method further comprising paying the player greater than even money of said base wager if the dealer's hand matches said bonus outcome.

3. The improved method of claim 1 wherein the wagering game is of the type where, if each game hand of the player hand outranks each game hand of the dealer hand, the player is rewarded even money on said base wager less a commission, the method further comprising waiving the commission if the dealer's hand matches said bonus outcome.

4. An improved method for the play of a wagering game, the improvement comprising:

providing a set of game indicia for play of the game;

establishing a predetermined ranking of hands of said game indicia;

the player making a base wager;

the player making a side wager in addition to said base wager;

after the player makes said side wager, distributing a player hand of game indicia and a dealer hand of game indicia;

the dealer arranging the dealer hand of game indicia into at least one game hand;

the player arranging the player hand of game indicia into at least one game hand;

comparing the ranking of each game hand of the player hand to the ranking of a corresponding game hand of the dealer hand;

resolving said base wager;

designating at least one dealer hand indicia combination as a bonus outcome; and if the dealer hand matches said bonus outcome providing an award to the player based on the player side wager placed prior to the distribution of any game indicia.

5. An improved method for playing Pai Gow Poker between a player and a dealer using at least one deck of playing cards and using a predetermined ranking of hands, where the player makes at least a base wager, after making said base wager the player is dealt a player hand of playing cards and the dealer is dealt a dealer hand of playing cards, arranging each of said player hand and said dealer hand into a two-card low hand and a five-card high hand wherein said low hand cannot have a higher ranking than said high hand according to said predetermined ranking of hands, and where the player's high and low hands are compared to the dealer's high and low hands, respectively, to resolve base wager, the improved method comprising:

designating at least one dealer hand combination as a bonus combination; and if the dealer's hand matches a bonus combination, providing an award to the player based on a wager placed prior to the dealing of any playing cards.

6. The improved method of claim 5 further comprising exacting a commission against the player where the base wager is resolved in the player's favor but waiving said commission if the dealer's hand matches a bonus combination and the base wager is resolved in the player's favor.

7. The improved method of claim 5 further comprising:

the player making a side wager prior to the dealing of any playing cards; and if the dealer's hand matches a bonus combination, providing an award to the player based upon said side wager placed prior to the dealing of any playing cards.

8. The method of claim 7 further comprising:

designating at least one player hand as a bonus combination; and if the dealer's hand matches a bonus combination and the player's hand matches a bonus combination, providing an award to the player based upon said side wager placed prior to the dealing of any playing cards.

9. An improved method for playing Pai Gow between a player and a dealer using a set of Pai Gow playing tiles and using a predetermined ranking of hands, where the player makes at least a base wager, after making said base wager the player is dealt a player hand of playing tiles and the dealer is dealt a dealer hand of playing tiles, each of said player and dealer arranging said player hand and dealer hand, respectively, into a two-tile high hand and a two-tile low hand wherein said low hand cannot have a higher ranking than said high hand according to said predetermined ranking of hands, and where the player's high and low hands are compared to the dealer's high and low hands, respectively, to resolve the base wager, the improved method comprising:

designating at least one dealer hand combination as a bonus combination; and if the dealer's hand matches a bonus combination, providing an award to the player based on a wager placed prior to the dealing of any playing tiles.

10. The improved method of claim 9 further comprising exacting a commission against the player where the base wager is resolved in the player's favor but waiving said commission if the dealer's hand matches a bonus combination and the base wager is resolved in the player's favor.

11. The improved method of claim 9 further comprising:

the player making a side wager prior to the dealing of any playing tiles; and if the dealer's hand matches a bonus combination, providing an award to the player based upon said side wager placed prior to the dealing of any playing tiles.

12. The method of claim 11 further comprising:

designating at least one player hand as a bonus combination; and if the dealer's hand matches a bonus combination and the player's hand is a bonus combination, providing an award to the player based upon said side wager placed prior to the dealing of any playing tiles.

13. An improved method of playing Three Card Poker between a player and a dealer using at least one deck of playing cards and using a predetermined ranking of hands, where the player makes at least an ante wager, after making said ante wager the player and a dealer are dealt a player hand of three cards and a dealer hand of three cards, respectively, the player, after seeing his three cards, opts to make either a play wager equal to the ante or fold and forfeit the ante, and where the rankings of the player hand and dealer hand are compared and (i) if the dealer hand does not have a qualifying holding the player being issued an award based on his ante and the play wager being a push, (ii) if the dealer hand does not have a qualifying holding and the player hand outranks the dealer hand the player being issued an award based upon his ante and play wager, or (iii) if the dealer hand does have a qualifying holding and the dealer hand outranks the player hand, the player losing the ante and play wager, the improved method comprising:

designating at least one dealer hand combination as a bonus combination; and if the dealer's hand matches a bonus combination, providing an award to the player based on one of said wagers placed prior to the dealing of any playing cards.

14. The method of claim 13 further comprising providing an award based on one of said wagers placed prior to the dealing of any playing cards to the player where the player hand outranks the dealer hand and the dealer hand matches said bonus combination.

15. The method of claim 13 further comprising:

designating at least one player hand combination as a bonus combination; and if said player's hand matches said bonus combination providing an award to the player based on one of said wagers placed prior to the dealing of any playing cards.

16. An improved method for the play of Pai Gow Poker between at least one player and a dealer using at least one deck of playing cards, and using a predetermined ranking of hands where the player is dealt a player hand of playing cards and the dealer is dealt a dealer hand of playing cards, where each player and said dealer arrange cards dealt to them into a two-card low hand and a five-card high hand, where the player has a winning hand if the player's high and low hands outrank the dealer's high and low hands, respectively, and where a commission is collected against awards on any winning player hand, said improvement comprising:

preselecting at least one dealer hand holding as a bonus holding;

each player making a wager prior to the dealing of any playing cards; and if said dealer hand matches said bonus holding providing an award to the player based on said wager placed prior to the dealing of any playing cards, the award selected from the group consisting of (1) where the player high and low hands outrank the dealer high and low hands, paying the player an enhanced award for his winning hand, (2) where the player high and low hands outrank the dealer high and low hands, waiving any commission to be collected from the player.

17. An improved method for the play of Pai Gow Poker between a player and a dealer using at least one deck of playing cards, and using a predetermined ranking of hands where the player is dealt a player hand of playing cards and the dealer is dealt a dealer hand of playing cards, where each of said player and said dealer arrange cards dealt to them into a two-card low hand and a five-card high hand, where the player has a winning hand if the player's high and low hands outrank the dealer's high and low hands, respectively, said improvement comprising:

preselecting at least one dealer hand holding as a bonus holding;

the player making a side wager prior to the dealing of cards; and issuing an award to the player making the side wager when the dealer's hand is one of said at least one bonus holding.

18. The method of claim 17 further comprising issuing an award to the player making the side wager prior to the dealing of any playing cards when the dealer hand is one of said at least one bonus holding and the player hand is a predetermined player hand combination.

19. An improved method for the play of Pai Gow between at least one player and a dealer using a set of Pai Gow playing tiles, and using a predetermined ranking of hands where each player is dealt a player hand of playing tiles and the dealer is dealt a dealer hand of playing tiles, where each player and said dealer arrange playing tiles dealt to them into a two-tile low hand and a two-tile high hand, where the player has a winning hand if the player's high and low hands outrank the dealer's high and low hands, respectively, and where a 5% commission is collected against awards on any winning player hand, said improvement comprising:

preselecting at least one dealer hand holding as a bonus holding;

each player making a wager prior to the dealing of any playing tiles; and if said dealer hand matches said bonus holding and if the player hand outranks the dealer hand, at least one of (1) paying the player an enhanced award based on said wager placed prior to the dealing of any playing tiles or (2) waiving the 5% commission to be collected from the player based on said wager placed prior to the dealing of any playing tiles.

20. An improved method for the play of Pai Gow between at least one player and a dealer using a set of Pai Gow playing tiles, and using a predetermined ranking of hands where each player is dealt a player hand of playing tiles and the dealer is dealt a dealer hand of playing tiles, where each player and said dealer arrange tiles dealt to them into a two-tile low hand and a two-tile high hand, where the player has a winning hand if the player's high and low hands outrank the dealer's high and low hands, respectively, said improvement comprising:

preselecting at least one dealer hand holding as a bonus holding;

the player making a side wager prior to the dealing of playing tiles; and issuing an award to the player making the side wager when the dealer's hand is one of said at least one bonus holding.

21. The improved method of claim 20 further comprising issuing an award to the player making said side wager when the dealer's hand is one of said at least one bonus holding and the player hand is a predetermined player hand combination.

22. An improved method for the play of Pai Gow between at least one player and a dealer using a set of Pai Gow playing tiles and using a predetermined ranking of hands, where each player is dealt a player hand of playing tiles and the dealer is dealt a dealer hand of playing tiles, where each player and said dealer arrange tiles dealt to them into a two-tile low hand and a two-tile high hand, where the player has a winning hand if the player's high and low hands outrank the dealer's high and low hands, respectively, and where a 5% commission is collected against awards on any winning player hand, said improvement comprising:

preselecting at least one player hand holding as a bonus holding;

if the player has a winning hand and the player's hand is at least one of said at least one bonus holding, at least one of (1) paying the player an enhanced award or (2) waiving the 5% commission to be collected from the player.

23. An improved method for the play of Three Card Poker between at least one player and a dealer using at least one deck of playing cards and using a predetermined ranking of hands, where the player makes at least an ante wager and after making said ante wager each player and a dealer are dealt a player hand of three cards and a dealer hand of three cards, respectively, the player, after seeing his three cards, opts to make either a play wager equal to the ante or fold and forfeit the ante, and where the rankings of the player hand and dealer hand are compared and (i) if the dealer hand does not have a qualifying holding the player being issued an award based on his ante and the play wager being a push, (ii) if the dealer hand does have a qualifying holding and the player hand outranks the dealer hand the player being issued an award based upon his ante and play wager, or (iii) if the dealer hand does have a qualifying holding and the dealer hand outranks the player hand, the player losing the ante and play wager, said improvement comprising:

preselecting at least one dealer hand holding as a bonus holding;

if the dealer's hand matches said bonus holding and (i) the dealer does not have a qualifying holding or (ii) the player's hand outranks the dealer's hand, paying the player an enhanced award.

24. An improved method for the play of Three Card Poker between at least one player and a dealer using at least one deck of playing cards and using a predetermined ranking of hands, where the player makes at least an ante wager and after making said ante wager each player and a dealer are dealt a player hand of three cards and a dealer hand of three cards, respectively, where the player has a winning hand if the player's hand outranks the dealer's hand said improvement comprising:

preselecting at least one dealer hand holding as a bonus holding;

the player making a side wager prior to the dealing of cards; and issuing an award to the player making the side wager when the dealer's hand is one of said at least one bonus holding.

25. The improved method of claim 24 further comprising issuing an award to the player making the side wager when the dealer's hand is one of said at least one bonus holding and the player hand is a predetermined player hand combination.

* * * * *

US006811153C1

(12) EX PARTE REEXAMINATION CERTIFICATE (9339th)

United States Patent

Ko

(10) Number: US 6,811,153 C1

(45) Certificate Issued: Oct. 5, 2012

(54) METHOD OF PLAYING IMPROVED CARD GAMES

(76) Inventor: Shenli Ko, Las Vegas, NV (US)

Reexamination Request:
No. 90/011,873, Oct. 3, 2011

Reexamination Certificate for:

| | |
|---|---|
| Patent No.: | **6,811,153** |
| Issued: | **Nov. 2, 2004** |
| Appl. No.: | **10/369,250** |
| Filed: | **Feb. 19, 2003** |

(51) Int. Cl.
*A63F 3/00* (2006.01)
*A63F 1/00* (2006.01)

(52) U.S. Cl. ..... 273/292; 273/274

(58) Field of Classification Search ..... None
See application file for complete search history.

(56) References Cited

To view the complete listing of prior art documents cited during the proceeding for Reexamination Control Number 90/011,873, please refer to the USPTO's public Patent Application Information Retrieval (PAIR) system under the Display References tab.

*Primary Examiner* — Patricia Engle

(57) ABSTRACT

A player places a base wager and an optional proposition wager in a card game or the game of Pai Gow tiles or in Three-Card Poker where all players compete against the dealer on the base wager. If the dealer receives one of predetermined hand combinations, a player making the optional proposition wager is paid odds on the proposition wager. Additionally, if the dealer receives one of the predetermined dealer hand combinations and the player also receives one of predetermined player hand combinations, players are paid higher odds. Additionally or alternatively, in lieu of just a proposition payoff, the player may be paid an enhanced winning base game award or be waived a commission when the dealer or the player himself has a predetermined qualifying hand combination.

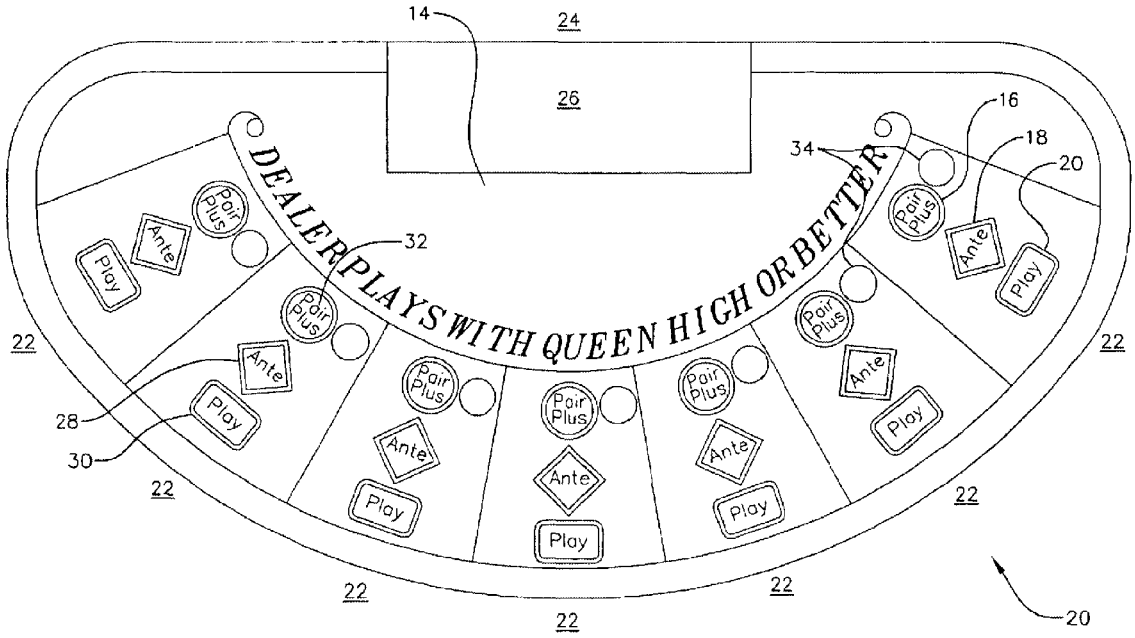

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 1 is confirmed.

Claims 4, 5, 7-9, 11-13, 15, 17, 18, 20, 21, 24 and 25 are cancelled.

Claims 2, 3, 6, 10, 14, 16, 19, 22 and 23 were not reexamined.

* * * * *